US009376873B2

(12) United States Patent
Moss et al.

(10) Patent No.: US 9,376,873 B2
(45) Date of Patent: Jun. 28, 2016

(54) HANDLING DEVICE FOR DRILL RODS AND SO-CALLED TOP DRIVE HAVING SUCH A HANDLING DEVICE

(71) Applicant: BENTEC GMBH DRILLING & OILFIELD SYSTEMS, Bad Bentheim (DE)

(72) Inventors: Johannes Moss, Nordhorn (DE); Heiko Schmidt, Münster (DE); Gerhard Groβe Veldmann, Bad Bentheim (DE)

(73) Assignee: Bentec GmbH Drilling & Oilfield Systems, Bad Bentheim (DE)

( * ) Notice: Subject to any disclaimer, the term of this patent is extended or adjusted under 35 U.S.C. 154(b) by 117 days.

(21) Appl. No.: 14/367,699

(22) PCT Filed: Nov. 19, 2012

(86) PCT No.: PCT/EP2012/073016

§ 371 (c)(1),
(2) Date: Jun. 20, 2014

(87) PCT Pub. No.: WO2013/092055

PCT Pub. Date: Jun. 27, 2013

(65) Prior Publication Data

US 2014/0360780 A1 Dec. 11, 2014

(30) Foreign Application Priority Data

Dec. 21, 2011 (DE) ..... 10 2011 089 500

(51) Int. Cl.
*E21B 19/06* (2006.01)
*E21B 19/00* (2006.01)
*E21B 19/16* (2006.01)
*E21B 3/02* (2006.01)

(52) U.S. Cl.
CPC . *E21B 19/06* (2013.01); *E21B 3/02* (2013.01); *E21B 19/00* (2013.01); *E21B 19/165* (2013.01)

(58) Field of Classification Search
CPC ..... E21B 19/06; E21B 19/00; E21B 3/02
See application file for complete search history.

(56) References Cited

U.S. PATENT DOCUMENTS 4,489,794 A * 12/1984 Boyadjieff ..... E21B 19/02 166/77.52
4,800,968 A * 1/1989 Shaw ..... E21B 19/02 166/66.5
9,051,788 B2 * 6/2015 Hofste ..... E21B 19/08

(Continued)

FOREIGN PATENT DOCUMENTS

DE 10 2009 039022 3/2011

*Primary Examiner* — Shane Bomar
(74) *Attorney, Agent, or Firm* — King & Spalding LLP

(57) ABSTRACT

The invention relates to a handling unit for drill rods having an elevator bracket (30) which can be swiveled by means of a tilt arm (34) under the influence of a tilt cylinder (32), and means (42) for detecting a position of the at least one elevator bracket (30), in which is provided at least one valve (50) as means for detecting the position of the or each elevator bracket (30) and as part of a hydraulic switching control circuit (54) which continues outside the handling unit, and at least one connecting member (52) for the at least one valve (50), which connecting member can be moved by a movement of the tilt arm (34), wherein the or each valve (50) opens or closes the hydraulic switching control circuit (54) such that the state of the switching control circuit (54) can be evaluated as position information.

10 Claims, 10 Drawing Sheets

(56) References Cited

U.S. PATENT DOCUMENTS

2010/0289285 A1* 11/2010 Stoldt ..... E21B 19/06
294/194

2012/0152530 A1* 6/2012 Wiedecke ..... E21B 19/07
166/250.01

* cited by examiner

HANDLING DEVICE FOR DRILL RODS AND SO-CALLED TOP DRIVE HAVING SUCH A HANDLING DEVICE

RELATED APPLICATIONS

This application is a Section 371 national phase application of and claims priority to PCT application PCT/EP2012/073016 filed on Nov. 19, 2012, which claims priority to German Patent Application Number 10 2011 089 500.0 filed on Dec. 21, 2011, the contents of which are incorporated herein in their entirety.

TECHNICAL FIELD

Handling device for drill rods and so-called top drive having such a handling device.

BACKGROUND

The invention relates to a handling device for drill rods for deep boreholes, e.g. for crude oil and natural gas exploration. The term "pipe handler" has become established in technical terminology for such a handling device, and accordingly the term "pipe handler" is used in the following synonymously with the expression "handling unit for drill rods".

A pipe handler is part of a so-called top drive, that is to say the vertically moving drive unit in the mast of a drilling rig which sets the drill rods into rotational movement for the drilling process by means of a drive assembly, usually an electric motor, which is contained within the drive unit. For this purpose, the top drive is divided into a fixed and a rotatable unit. The fixed unit comprises the drive assembly. The element which can be rotated by the drive assembly is the pipe handler. The units of the pipe handler are supplied via a rotary hydraulic union between fixed and rotatable part of the top drive, namely in that a pressurized hydraulic fluid is applied to the pressure cylinder and the like, for example to move so-called elevator brackets or to activate holding tongs for drill rods provided on a so-called torque arm.

A swivel movement capability is provided especially for the elevator brackets of the pipe handler, as the elevator brackets (usually two) carry a so-called rod elevator at the ends thereof in order to remove drill rod elements from a store and to feed the removed drill rod element to the holding tongs at the end of the torque arm.

A certain quantity of drill rod elements is normally held available vertically next to or on the mast of the drilling rig for storage purposes, and a so-called fingerboard, which is located on the mast in the region of the top end of the stored drill rod elements, is provided for this purpose. An additional or alternative storage position for at least one drill rod element is the so-called mouse hole. Up to now, the removal of drill rod elements from their storage position and also in the opposite direction, namely the depositing of drill rod elements in a storage position, has been carried out under manual control. For this purpose, the top drive is moved to an appropriate vertical position in the mast which enables drill rod elements to be removed or deposited. As soon as the top drive is in this position, the or each elevator bracket is swiveled and a drill rod element is collected or deposited by means of the rod elevator.

With regard to a problem which existed up to that point that essential control operations for initiating and concluding such handling processes were left substantially to the attention of the operating personnel, devices and methods with which a fully automatic monitoring of the pipe handler and/or of the top drive with pipe handler is possible have been proposed in DE 10 2009 039 022 A. In particular, a possible way of detecting a position of the at least one elevator bracket is specified. DE 10 2009 039 022 A is expressly included in the disclosure content of the present description, e.g. with regard to the electrical and hydraulic supply and control of the top drive explained therein. Further technical background of the relevant prior art, albeit only general in scope, can be seen from U.S. Pat. No. 4,326,745 and U.S. Pat. No. 4,800,968.

SUMMARY

An object of the invention described below consists in specifying a further embodiment of means for detecting a position of the at least one elevator bracket.

According to the invention, this object is achieved with the characteristics of claim 1. For this purpose, with a handling unit for drill rods having at least one elevator bracket which can be swiveled particularly by means of a tilt arm under the influence of at least one actuating element, and means for detecting a position of the at least one elevator bracket, at least one valve and at least one connecting member which can be moved by a movement of the tilt arm is provided. The or each valve functions as means for detecting the position of the or each elevator bracket and is part of a switching control circuit which continues outside the handling unit. The at least one connecting member is provided for the at least one valve, wherein the or each valve opens the hydraulic switching control circuit when the connecting member is in a first position or location, and wherein the or each valve closes the hydraulic switching control circuit when the connecting member is in a second position or location. As the respective position or location of the connecting member corresponds to a displacement of the at least one elevator bracket, position information regarding a displacement of the at least one elevator bracket is provided based on the closed or open hydraulic switching control circuit.

An advantage of the invention consists in that only one valve or one group of valves, for example two valves, and the part of a hydraulic switching control circuit in which the or each valve is located is required on the handling unit side as means for detecting a position of the at least one elevator bracket. The handling unit/pipe handler is the rotatable part of a top drive, and a rotary union is provided for decoupling between the rotatable and the fixed part. The hydraulic switching control circuit can be routed via this rotary union. As the or each valve opens or closes the hydraulic switching control circuit depending on a location or position of the connecting member, a pressure which can be sensed in the switching control circuit constitutes a measure of a position or displacement of the at least one elevator bracket. The hydraulic switching control circuit is therefore conceptually simple and the or each valve of the handling unit effects a transmission of a location or position of the respective connecting member and therefore a transmission of a basic displacement of the at least one elevator bracket in one state of the hydraulic switching control circuit. Pressure losses, for example, or similar, which can influence or falsify a detection of the position of the at least one elevator bracket, can be easily kept in check in such a simple switching control circuit. At the very least, a neutral position of the or each elevator bracket, which is also referred to in the following as zero position, can be detected by means of the or each valve, the or each associated moving connecting member and the switching control circuit which is influenced thereby. The zero position of the or each elevator bracket is a position in which the elevator brackets are usually suspended vertically, or at any rate a position of the elevator brackets in which a vertical movement of the top drive in the drilling mast is possible without collisions being able to occur, in particular of the or of each elevator bracket or of the tilt arm with parts of the drilling mast or objects located there. Such a position or displacement is referred to below as a collision-free position.

Advantageous embodiments of the invention are the subject matter of the dependent claims. Counter-references used here refer to the further development of the subject matter of the main claim by the features of the respective dependent claims; they are not to be understood as a renunciation of the achievement of independent, objective protection for the combination of characteristics of the referenced dependent claims. Furthermore, with regard to a setting out of the claims, when a characteristic is specified in more detail in a subsequent claim, it must be assumed in each case that no restriction of this kind is present in the preceding claims.

DETAILED DESCRIPTION OF EXAMPLE EMBODIMENTS

Figure 1:
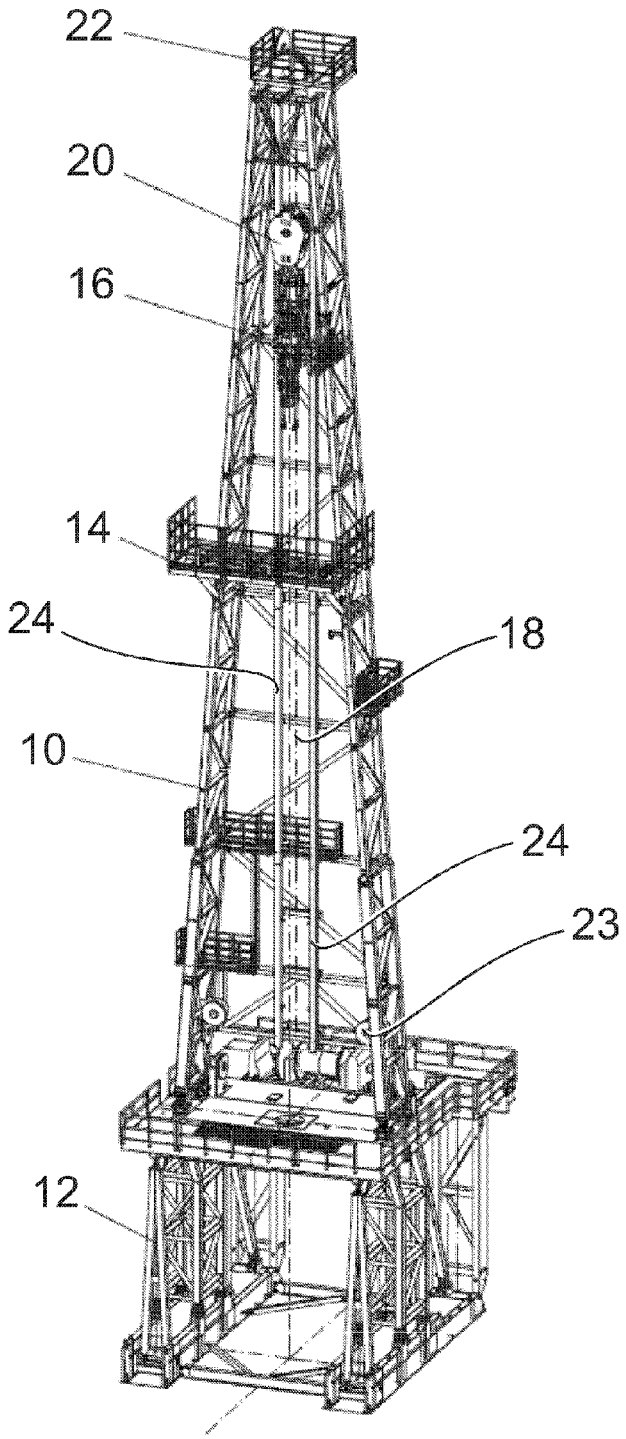
FIG. 1 shows, as part of a drilling rig, a mast with associated substructure and a top drive guided in the mast.

In a particular embodiment of the handling unit, it is provided that the or each connecting member can be rotated by means of an axle, and that at least one cam disk mounted on the axle functions as the connecting member. In order to interact with the connecting member, the respective valve has a roller which rests on the surface of the connecting member. In the case of a connecting member in the form of a cam disk which is mounted on an axle and can be rotated thereon, the valve roller lies externally on the cam disk and accordingly follows the course of the contour of the cam disk when the cam disk rotates. The valve may be actuated depending upon the rotational position of the cam disk and therefore upon a position of at least one section which is set back in the external circumference of the cam disk from an otherwise circular envelope contour. As the connecting member can be moved by a movement of the tilt arm and, on the one hand, the tilt arm effects the swiveling of the or each elevator bracket, and therefore a position of the tilt arm is also a measure of a position of the or each elevator bracket, the position of the connecting member, that is to say in particular a rotational position of the connecting member, is ultimately a measure of the position of the or each elevator bracket.

Here, a first position or location of the connecting member occurs when, in the case of a rotatable connecting member, the section coinciding with the circular envelope contour faces the valve. A second position or location of the connecting member occurs when a section which is set back from the circular envelope contour of the connecting member faces the valve. Such a set-back section functions like an inverse cam, and a roller or similar which is provided on the valve in the case of a rotatable connecting member basically drops into the depression formed in the connecting member such that the or each valve closes the hydraulic switching control circuit in such a second position or location of the connecting member.

To simplify the description, in the following, the section coinciding with the circular envelope contour of the connecting member is referred to as the first radius of the connecting member, and the section which is set back from the circular envelope contour of the connecting member is referred to as the second radius of the connecting member. The second radius is less than the first radius. The larger, first radius therefore acts in the first position or location of the connecting member, and, correspondingly, the smaller, second radius acts in the second position or location of the connecting member. The valve remains open as long as the first radius is active. As soon as the second radius is active, the valve closes.

In a particular embodiment of the handling unit, it is provided that two combinable cam disks, which can be rotated relative to one another on the common axle, function as the connecting member. Each of these cam disks has a section with a first radius and a section with a second radius. As the two cam disks can be rotated relative to one another, the active width of the connecting member with which the switching control circuit is opened can be adjusted. This enables a certain position range with regard to a particular displacement of the or each elevator bracket to be allowed as a zero position. Thanks to the ability to rotate the cam disks relative to one another, this permissible range can be adjusted and/or changed on site without having to replace the cam disk or cam disks for this purpose.

If the or each cam disk can be releasably locked in a fixed rotational relationship with respect to the axle, an off-center position of the or each elevator bracket, for example, can also be defined as the zero position. The same applies if the cam disk or two cam disks which can be rotationally offset relative to one another enable a position range to be specified.

Some numerical examples may possibly explain the above even better: With regard to the or each cam disk, as already indicated above, it is assumed that this is characterized by a circular envelope contour. Normally, the major part of the external surface of the cam disk which functions as a running surface for the valve roller coincides with this circular envelope contour. This is the section of the connecting element with the first radius. For a section of the connecting element with the second radius, it is assumed by way of example that this is twenty angular degrees wide. With an appropriate orientation of the cam disk, a displacement of plus ten degrees to minus ten degrees of the or each elevator bracket, for example, can be detected as the zero position, or at any rate as the collision-free position. In the case of two cam disks which can be rotatably offset with respect to one another, an addition or subtraction of the permitted position ranges can basically be achieved. In the case of two cam disks of the kind mentioned above, by minimally overlapping connecting member sections with the second radius, a section of forty angular degrees or of approximately forty angular degrees can therefore be defined as the permissible range. When the cam disks are rotationally offset with respect to one another in the direction of a lower overlap, this range reduces, thus also enabling permissible ranges of less than twenty angular degrees to be defined. As two cam disks which can be rotationally offset relative to one another are releasably locked on the axle, when the width of a permissible range is seven angular degrees, for example, settings relating to an actual displacement of the or each elevator bracket can be made such that displacements of, for example, minus two to plus five degrees are permissible. The ability of the cam disk or of two cam disks to be releasably locked and/or the possible ability of two cam disks to be rotationally offset relative to one another therefore enables considerable flexibility when setting a permissible range regarding a displacement of the or each elevator bracket. This setting can also be carried out on site and adjusted on site if required.

If the or each connecting member is driven by a pinion which runs in a chain which can be moved by the tilt arm, the chain and the pinion result in a step-up or step-down gearing of the movement of the tilt arm so that, for example, in the case of a rotatable connecting member, the permissible movement range of the tilt arm can be mapped onto the full outer circumference of the connecting member, or at any rate onto almost the full outer circumference of the connecting member. This enables a zero position, or at any rate a collision-free displacement, of the or each elevator bracket to be detected even more accurately and finely. With regard to the interaction of chain and pinion, it must be considered that a chain segment is attached to the tilt arm in such a way that the pinion can engage therein and that a movement of the tilt arm leads to a rotation of the pinion. If appropriate, a toothed rack or similar can be considered as an alternative to a chain.

A chain is suitable for attaching to the relevant section of the tilt arm particularly as, because of the ability of the chain links to move, the chain section directly follows a specified contour, which incidentally is designed such that a distance between an axle on which the pinion is located and the individual chain links remains the same regardless of a swivel position of the tilt arm. Of course, this active association can also be achieved with a curved tooth rack instead of the chain section, for example.

A translatory movement on an axle driven by the pinion can also be provided for the pinion such that this translatory movement is effective for tolerance compensation when this is necessary.

A particular embodiment of the handling unit is characterized in that two valves and two synchronously moving connecting members are provided, that is to say in each case one connecting member for each valve. This is expedient with regard to functional reliability which, in technical terminology, is categorized by means of so-called safety integrity levels (SIL).

The two valves operate redundantly. If a failure in the form of a leak were to occur in a single valve, no pressure would build up in the hydraulic switching control circuit. If, on the other hand, the failure of a valve should express itself in that it remains closed, then, because of the parallel connection of the two valves, the redundant valve is sufficient to produce a pressure drop in the hydraulic switching control circuit and to enable a signal relating thereto to be generated on this basis. As, in the case of two valves, the two connecting members provided for one valve in each case are moved synchronously, the possibility of a fault regarding the position detection is limited to the valves.

The invention described here is also a top drive having a base part and a part which can be rotated on the base part, wherein a handling unit as described here and in the following functions as the rotatable part, wherein the hydraulic switching control circuit runs via a rotary hydraulic union from the rotatable part to the base part, and wherein at least one pressure sensor for detecting a pressure in the hydraulic switching control circuit and for outputting a sensor signal relating thereto is located on the base part. The advantage of such a division of the switching control circuit, namely of the or each valve used therein and the or each pressure sensor used as a sensor, between the rotatable part on the one hand and the fixed base part on the other, enables a sensor signal generated by the or each pressure sensor to be generated in the region of the fixed base part of the top drive and therefore electrical signals do not have to be routed via the rotary hydraulic union.

When, with a top drive, in a hydraulic power circuit for controlling at least one hydraulic cylinder (link-tilt cylinder) which functions as an actuating element, a volume flow sensor for detecting a volume flow in the hydraulic power circuit and for outputting a sensor signal relating thereto is located on the base part as means for detecting the position of the or each elevator bracket, not only can a possible zero position of the or each elevator bracket be detected but also a respective deflection/swivel position.

A detection of a swivel position of the or each elevator bracket is expedient when, for example, certain deflections of the or each elevator bracket are to be invoked automatically. This is described in DE 10 2009 039 022 A mentioned above, which in this respect is included in the disclosure content of this description in order to avoid repetitions. The detection of certain swivel positions of the or each elevator bracket is also necessary when it is required to draw an imaginary envelope around the movement range of the top drive in the drilling mast, up to which the or each elevator bracket may be swiveled as a maximum. In order to avoid repetitions, reference is also made in this regard to the appropriate description in DE 10 2009 039 022 A, which in this respect is likewise to be considered to be included in the disclosure content of this application.

In an embodiment of the top drive, it is provided that the sensor signal obtainable from the or each pressure sensor and the sensor signal obtainable from the volume flow sensor can be fed as input signals to a control device which can be located on the top drive or, for example, also remotely from the top drive, that position information relating to a position of the at least one elevator bracket can be generated based on the sensor signal obtainable from the volume flow sensor, and that the position information can be calibrated based on the sensor signal obtainable from the pressure sensor. Such an ability to influence the position information by information relating to a possible zero position of the or each elevator bracket enables any inaccuracies, which can occur with the flow sensor due to the volume flow measured in each case in extended operation, to be compensated for. As the position information is calibrated, in particular set to zero, based on the sensor signal obtainable from the pressure sensor, that is to say to a certain extent based on a signal indicating a zero position of the or each elevator bracket, possible errors in the volume flow detection are in each case restricted to single swivel operations, so that any errors are already systematically restricted and, above all, any errors do not accumulate over a plurality of swivel operations.

The patent claims submitted with the application are formulation proposals without prejudice for achieving further patent protection. As, with regard to the prior art on the date of priority, the subject matter of the dependent claims in particular can form distinct and independent inventions, the applicant reserves the right to make these or further combinations of characteristics, which up to now have only been disclosed in the description and/or drawing, the subject matter of independent claims or declarations of division. Furthermore, they can also contain stand-alone inventions which have a form which is independent of the subject matter of the preceding dependent claims.

An exemplary embodiment of the invention is explained in more detail below with reference to the drawing. Corresponding objects or elements are given the same references in all the figures. The or each exemplary embodiment is not to be looked upon as a restriction of the invention. Rather, numerous amendments and modifications are possible as part of the present disclosure, in particular such variants, elements and combinations and/or materials, which, for example, regarding the achievement of the object, can be gathered by the person skilled in the art by combination or modification of individual characteristics or elements or method steps described in conjunction with the general or special description part and contained in the claims and/or the drawing, and as a result of combinable characteristics lead to new subject matter or to new method steps or sequences of method steps, including where they relate to manufacturing, testing and working methods.

FIG. 1 shows a mast 10 with associated substructure 12 as part of a drilling rig. In the situation shown, a so-called fingerboard 14 is located on the mast 10 in a manner which is known per se, wherein the fingers contained therein are metal rods or metal profiles which are provided for uprighting, that is to say vertically storing, drill rod elements which are deposited there.

A so-called top drive 16, which, when the drilling rig is in operation, is provided for lowering or raising the drill rods 18 (not shown; only indicated by dashed lines) and for rotating the drill rods 18 for effecting the drilling process, is arranged in the mast 10 in a manner which is known per se. The top drive 16 is suspended from a pulley block 20. The pulley block 20 and a crown block 22 located in the region of a mast crown act together as a block and tackle. A hoisting rope (not shown) for a vertical movement of the top drive 16 runs from the crown block 22 to a unit provided in the region of the drilling rig, e.g. a winch 23, which can be driven by an electric motor. For the vertical movement, the top drive 16 is held in at least one guide rail 24.

Figure 2:
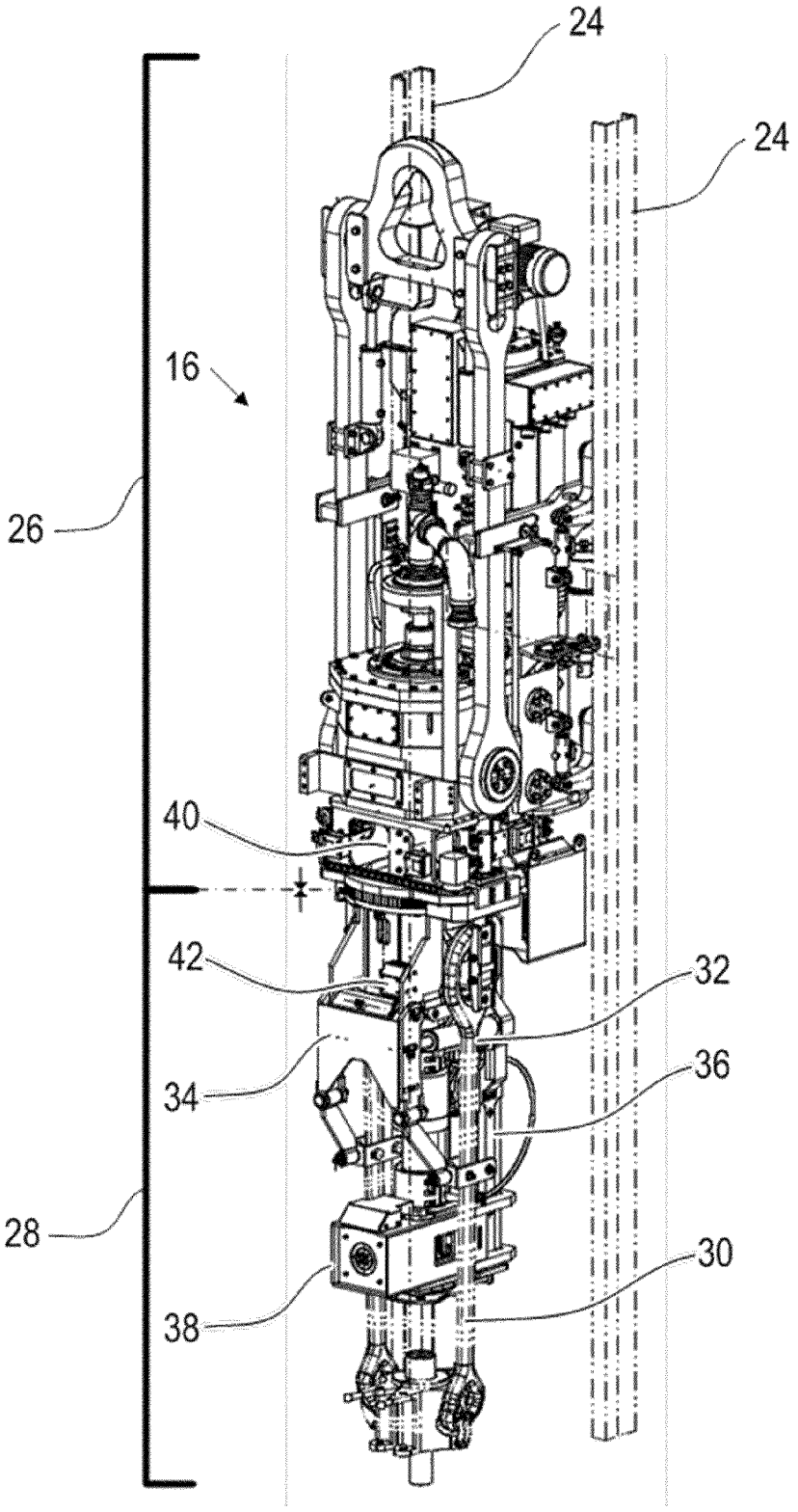
FIG. 2 shows the top drive with further details, in particular a so-called pipe handler contained in the top drive, and swiveling elevator brackets located thereon.

FIG. 2 shows the top drive 16 from FIG. 1 with further details. According to this, the top drive 16 comprises a fixed part 26 and a rotatable part 28. The fixed part 26 comprises the drive for moving the rotatable part 28, for example in the form of a motor. The fixed part 26 of the top drive is accordingly also referred to as the base part or drive unit, and "fixed" means that it is the part of the top drive 16 which has a fixed rotational relationship and, as a whole, can be moved vertically in the guide rails 24. The rotatable part 28 of the top drive 16 is referred to in technical terminology and accordingly also here as pipe handler and comprises at least one swiveling elevator bracket 30 and at least one actuating element 32 for effecting the swivel operation of the or each elevator bracket 30. In the embodiment shown, two elevator brackets 30 are provided and the description is continued below in each case with reference to two elevator brackets 30 without forgoing further generality.

In a rest position, the elevator brackets 30 are aligned substantially vertically, i.e. the elevator brackets 30 hang vertically downwards. A vertical movement of the top drive 16 along the guide rails 24 in the mast 10 is possible, at least in such a position, without having to worry about the danger of the elevator brackets 30 colliding with parts in or on the mast 10, for example with the fingerboard 14 (FIG. 1) or one of the guide rails 24. Such a rest position is an example of a zero position of the elevator brackets 30, or at any rate an example of a collision-free position of the elevator brackets 30.

In the embodiment of the pipe handler shown, the actuating element 32 does not act directly on the elevator brackets 30, but initially on a so-called tilt arm 34, which for its part engages with the elevator brackets 30 such that a swiveling of the tilt arm 34 initiated by the at least one actuating element 32 results in a swiveling of the elevator brackets 30. In technical terminology, the actuating element 32 is frequently also referred to as the tilt cylinder.

Further parts of the top drive 16 or its pipe handler—however without particular importance for the invention—are a so-called torque arm 36 and holding tongs 38 for drill rods provided at its bottom end.

A rotary hydraulic union 40 is located between fixed part 26 and rotatable part 28 of the top drive 16. For the purpose of swiveling the elevator brackets 30, hydraulic fluid, for example, passes via this union from the fixed part 26 of the top drive 16 to the or each actuating element 32 provided for the purpose. A so-called port is provided in the rotary hydraulic union 40 for each hydraulic connection of this kind between the two parts 26, 28 of the top drive 16.

Means for detecting a position of the at least one elevator bracket 30 are designated by the reference 42. This is explained in the following with further details.

Figure 3:
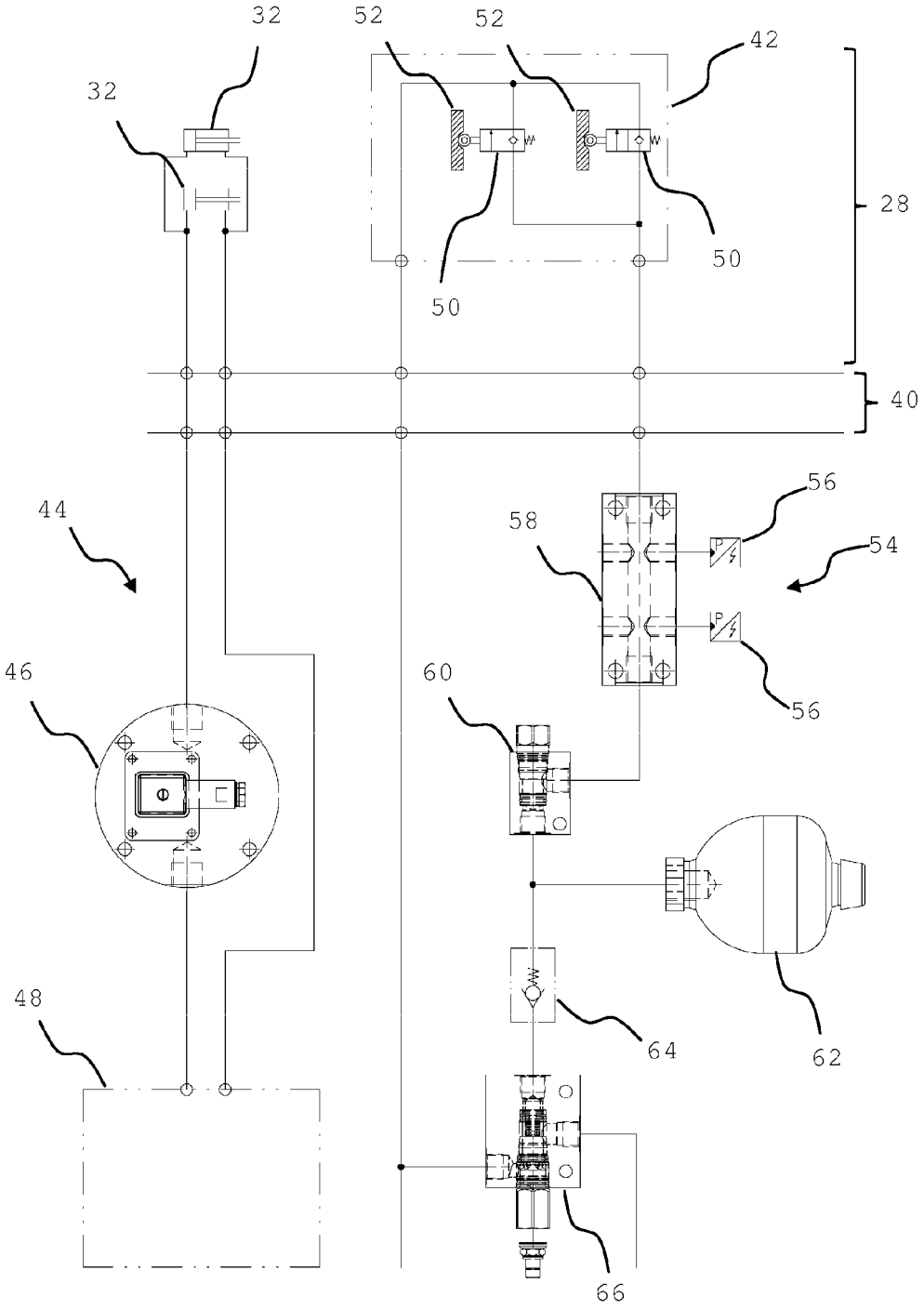
FIG. 3 shows a hydraulic equivalent circuit diagram with a hydraulic power circuit and a hydraulic switching control circuit, the state of which can be evaluated as position information with regard to a position or deflection of the elevator brackets.

FIG. 3 initially shows a hydraulic equivalent circuit diagram of said means. The horizontal dividing lines drawn in the middle of the diagram designate the rotary hydraulic union 40. All elements shown above the rotary hydraulic union 40 in FIG. 3 are located in or on the rotatable part 28 of the top drive 16, that is to say on the pipe handler. A hydraulic power circuit 44 together with the actuating elements 32 on the pipe handler, that is to say the tilt cylinders, is shown on the left. A volume flow sensor 46 is part of the hydraulic power circuit 44. In operation, the volume flow sensor 46 measures a volume flow in the hydraulic power circuit 44 and therefore a measure of a swivel position of the elevator brackets 30 when at least one tilt cylinder, which functions as actuating element 32, is activated. Along with the means 42 described below, the volume flow sensor 46 is therefore likewise a means for detecting the position of the elevator brackets 30. The hydraulic power circuit 44 can be supplied directly from a hydraulic power pack or branched off from a valve manifold 48. In the case of a branch from a valve manifold 48, the swiveling of the elevator brackets 30 can be influenced by a suitable actuation of the outputs of the valve manifold 48.

On the right-hand side, FIG. 3 shows two valves 50 connected hydraulically in parallel as means 42 (FIG. 2) for detecting the position of the elevator brackets 30. A plurality of valves 50 is necessary for complying with a certain safety level (SIL). Basically, one valve 50 is sufficient. This also applies to all elements described below as being duplicated, and the description is continued in accordance with the visual representations which show an embodiment for the increased safety level, that is to say an embodiment with redundant units, but without forgoing further generality.

Each valve 50 is guided in a connecting member 52 which can be moved by a movement of the tilt arm 34. In a first position or location of the connecting member 52, each valve 50 opens a hydraulic switching control circuit 54 in which the valve 50 functions as a switching element. In a second position or location of the connecting member 52, each valve 50 closes the hydraulic switching control circuit 54.

As can be seen from the diagram in FIG. 3, the hydraulic switching control circuit 54 extends starting from a section with the two valves 50 arranged on the pipe handler via the rotary hydraulic union 40 and continues outside the pipe handler. In this section, at least one pressure sensor 56 is provided, here two pressure sensors 56, which are connected to the hydraulic switching control circuit 54 by means of a manifold block 58. The following optional units are located downstream of the manifold block 58: a flow regulator valve 60, a reservoir 62, a non-return valve 64 and a pressure control valve 66.

Whenever the valves 50 close the hydraulic switching control circuit 54 due to a first position or location of the connecting members 52, a pressure, which can be sensed by means of the pressure sensor 56, builds up between the valves 50 and the pressure control valve 66. The optional flow control valve 60 prevents too great a pressure loss in the remaining system. When the hydraulic power pack is switched off or the system pressure is low, the reservoir 62 maintains the pressure between the valves 50 and the non-return valve 64.

It is important that a position of the valves 50 can be sensed by means of the hydraulic switching control circuit 54, wherein, by means of the connecting members 52 which move with a movement of the tilt arm 34, a detection of a position of the valves 50 corresponds to a detection of a position of the at least one elevator bracket 30. When namely the connecting members 52 are located in a second position or location, the or each valve 50 closes the hydraulic switching control circuit 54 such that this can be sensed by the two pressure sensors 56 as pressure in the range of a specified or specifiable order of magnitude in the hydraulic switching control circuit 54.

Figure 4:
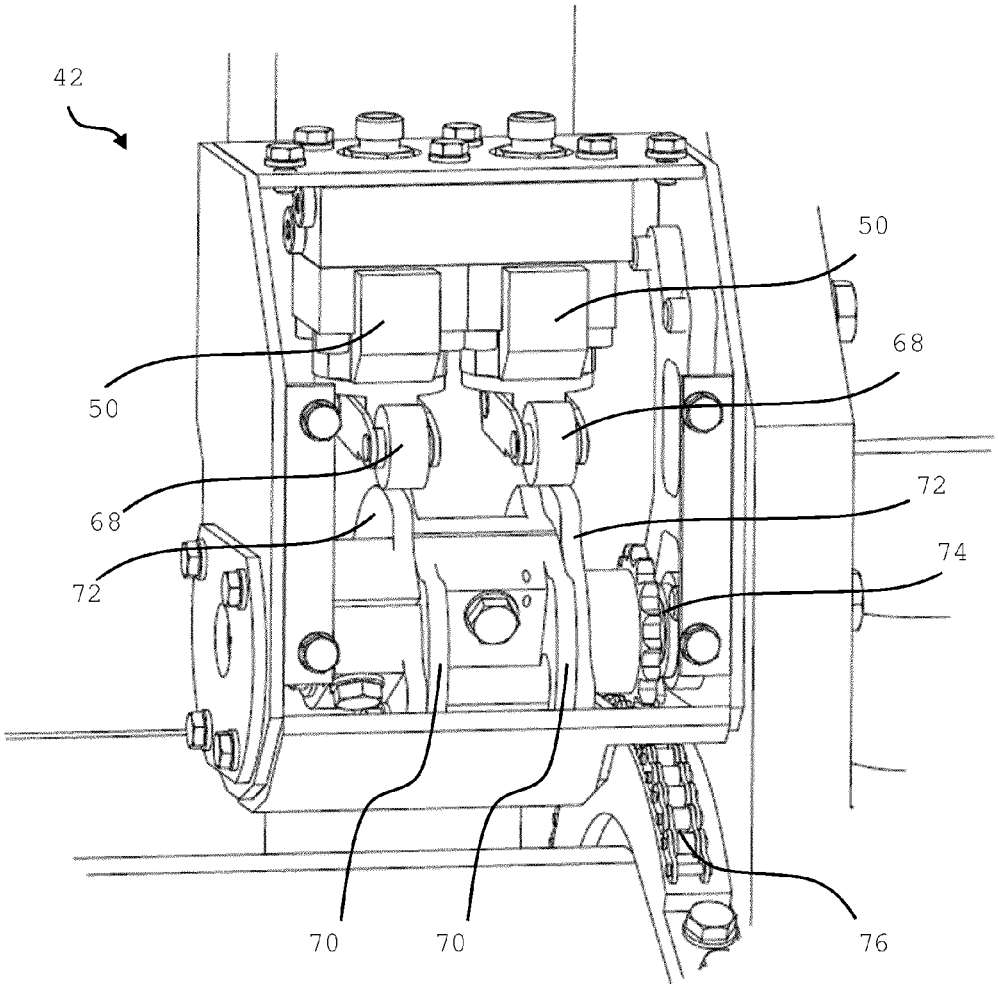
FIG. 4 shows a diagram of means for detecting the position of the or each elevator bracket and a camshaft included therein.

FIG. 4 shows a detail diagram of the means 42 for detecting the position of the or each elevator bracket 30. In a top section of the device relating thereto can be seen the two valves 50, which are arranged next to one another and which, by means of rollers 68, contact two cam disks 70, 72 which function as connecting members 52 (FIG. 3). A pair of cam disks 70, 72 is associated with each valve 50 so that, in total, four cam disks 70, 72 are provided. The cam disks 70, 72, and thus the connecting members 52 formed by their outer circumferential surfaces, are driven by a pinion 74 which runs in a chain 76 which can be moved by the tilt arm.

Figure 5:
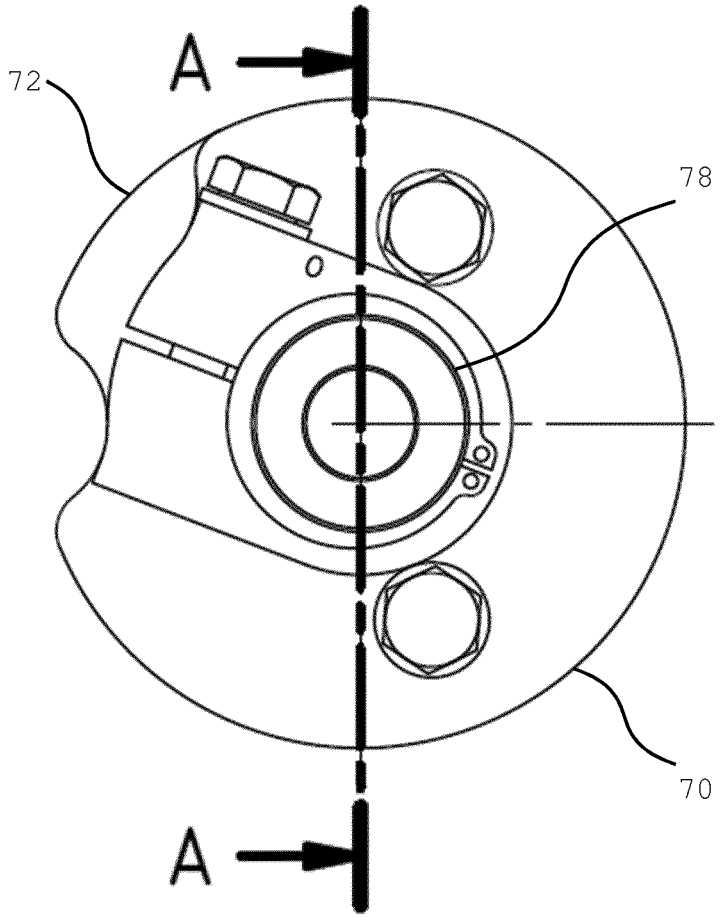
FIG. 5 shows the camshaft in a side view.

In a side view of the device according to FIG. 4, FIG. 5 shows only the unit, which can also be described as the camshaft, with the cam disks 70, 72. With regard to the cam disks 70, 72, it can be seen that these each have a circular envelope contour. Here, a significant section of the outer circumference of the cam disks 70, 72 coincides with the circular envelope contour. However, part of the outer contour of the cam disks 70, 72 is set back from the circular envelope contour so that an inverse cam, so to speak, is located in this area. In accordance with the introductory comments, here too the section of the cam disk 70, 72 which coincides with the circular envelope contour is described as a section with a first radius, and that of the section of the cam disk 70, 72 which is set back from the circular envelope contour is described as a section with a second radius or described as an inverse cam.

With the cam disk 70 which lies on top in the diagram in FIG. 5, the section with the second radius which is set back from the circular envelope contour is located approximately in a region from 9 o'clock to 11 o'clock. This region can only be partially seen with the second cam disk 72 which lies behind the first cam disk 70. At any rate, the section with the second radius which is set back from the circular envelope contour ends at approximately 9 o'clock. From this it can already be seen that the two cam disks 70, 72 can in each case be rotated relative to one another on a common axle 78, resulting in a specific contour of the connecting member 52 formed by the two combined cam disks 70, 72 depending on the relative position of the two cam disks 70, 72. In the example shown in FIG. 5, this is only a region set back from the circular sleeve contour of the two combined cam disks 70, 72 at approximately 9 o'clock. It can therefore be seen that the effective width of the resulting inverse cam can be adjusted, that is to say increased or decreased, by the relative position of the two cam disks 70, 72 with respect to one another. In addition, each cam disk 70, 72 can also be releasably locked in a fixed rotational relationship with respect to the axle 78. This enables the position of the inverse cam to be affected, and, after releasing the or each cam disk 70, 72, the inverse cam, which in the diagram in FIG. 5 is oriented towards 9 o'clock, can easily be moved on the axle 78 into a position such as 6 o'clock for example, thus resulting in a different switching point formed by the connecting member 52/the cam disks 70, 72 when the or each cam disk 70, 72 is subsequently locked on the axle 78.

Figure 6:
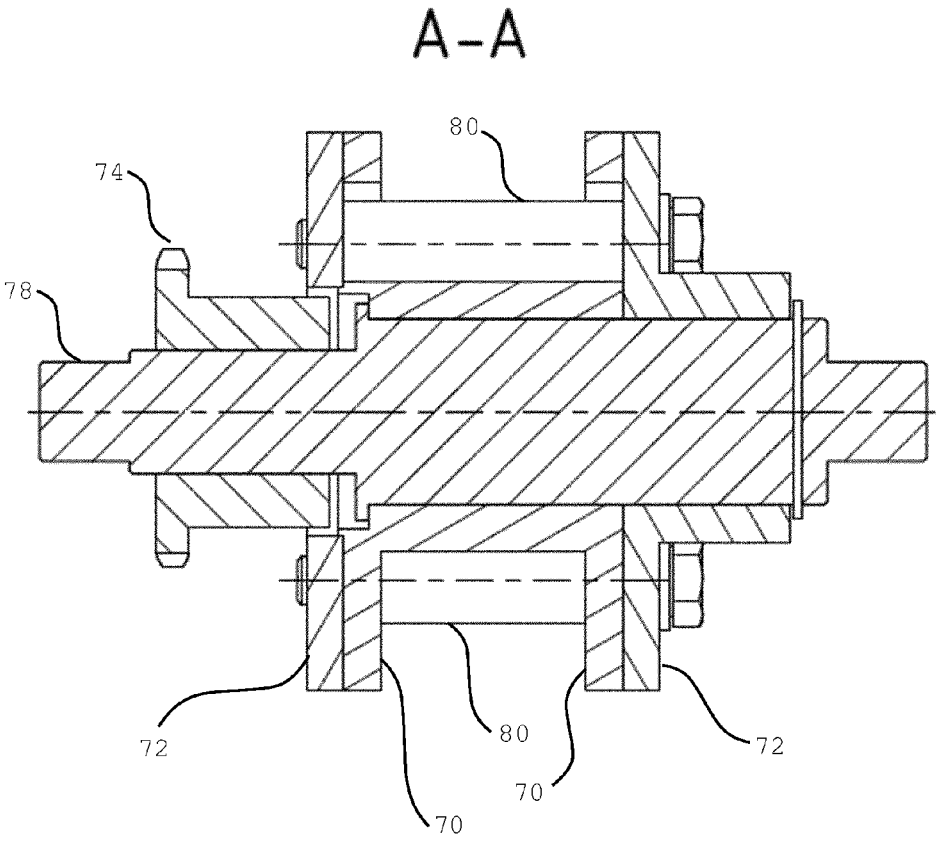
FIG. 6 shows a sectional view of the camshaft.

FIG. 6 shows a section through the camshaft from FIG. 5 along the section line designated by A-A. The axle 78 and the pinion 74, which is provided to drive the axle 78 and therefore to rotate the camshaft as a whole, can be seen.

Together with a screw-operated clamp connection, the two first cam disks 70, which here are shown inwardly lying, forma component which can be locked on the axle 78. This has a corresponding cam geometry left and right, namely the cam disks 70. This correspondence of the cam geometry also applies to the two second cam disks to enable the valves 50 to switch synchronously. One of the two second cam disks, namely the second cam disk 72 facing away from the pinion 74, can likewise be locked on the axle 78 by means of an appropriate screw-operated clamp connection. The second cam disk 72 facing the pinion 74 is screwed to the other second cam disk 72 which faces away from the pinion 74 with the help of distance sleeves 80 and associated screws in order to ensure that the two valves 50 always switch synchronously even after the second cam disks 72 have been moved. It is advantageous that the two first cam disks 70 remain movable between the two second cam disks 72 even after the two second cam disks 72 have been screwed together. This enables the respective endpoints of the inverse cam of the connecting member to be adjusted separately from one another without always having to release the two pairs of cam disks 70, 72 at the same time.

Figure 7:
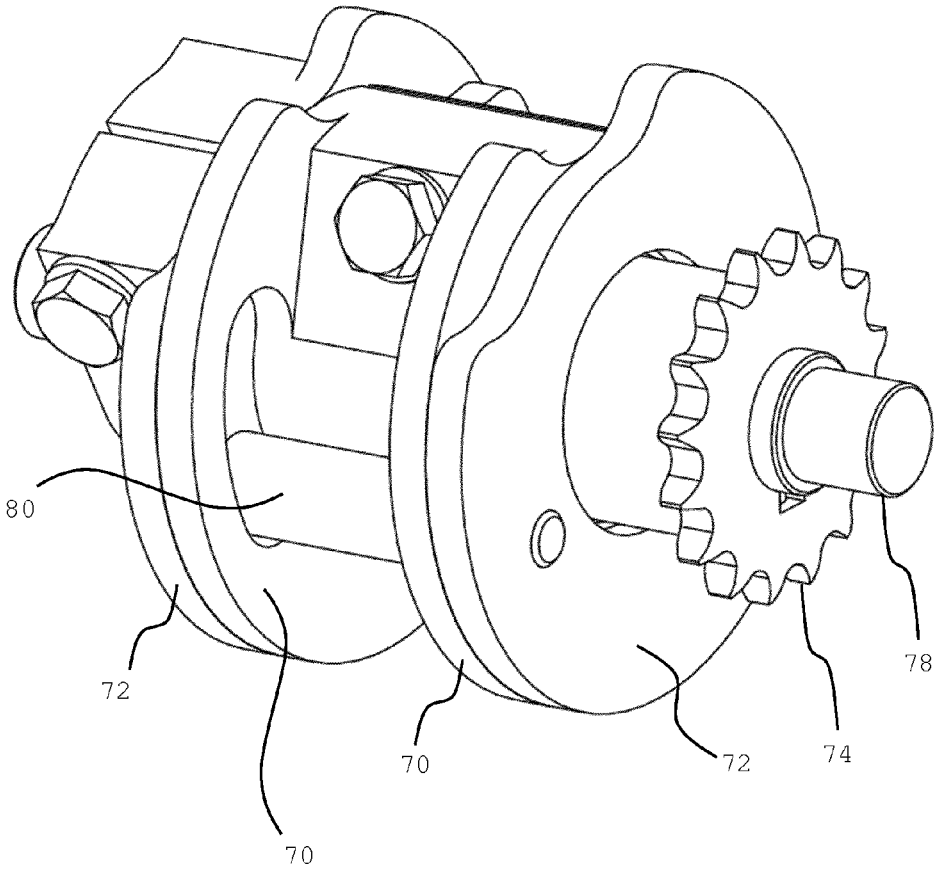
FIG. 7 shows the camshaft in isometric view.

FIG. 7 shows the relationships according to FIG. 6 in an isometric view. The cam disks 70, 72, the pinion 74 and the axle 78 can be seen. With regard to the screw bolts 80, it can be seen that an elongated hole is provided for them in the inner cam disks 70 through which they pass, so that, on the one hand, the elongated hole affords the two cam disks 70, 72 an ability to rotate relative to one another, but, on the other, also limits the scope of such an ability to rotate.

Starting from the description relating to FIGS. 5, 6 and 7, it now becomes clear, in conjunction with FIG. 4, how the camshaft interacts with the at least two connecting members 52 formed by cam disks 70, 72 arranged in pairs. Whenever a roller 68 of a valve 50 drops into the inverse cam formed by two cam disks 70, 72 in each case, the respective valve 50 closes the hydraulic switching control circuit 54. A location or position of the connecting member 52 so formed, in which the roller 68 enters such an inverse cam, is therefore a second position or location of the connecting member 52 in which the hydraulic switching control circuit 54 is closed. In contrast with this, every location or position of the connecting member 52, in which the roller 68 of a particular valve 50 rests against the outer circumferential surface of at least one of the two cam disks 70, 72 which coincides with the circular envelope contour, is a first position or location of the connecting member 52 so formed in which the hydraulic switching control circuit 54 is open. An opening of the valve 50 or one of the valves 50 therefore effects a pressure loss in the hydraulic switching control circuit 54 which can be sensed by means of the pressure sensor 56 or the pressure sensors 56, and, as the connecting member 52 formed by the cam disks 70, 72 can be moved by a movement of the tilt arm 34, such a pressure loss indicates a position of the or each elevator bracket 30.

An appropriate locking of the or each cam disk 70, 72 on the axle 78 enables the inverse cam to be adjusted such that it indicates exactly a zero position, that is to say a position in which the or each elevator bracket 30 is suspended substantially vertically. As the cam disks 70, 72 can be locked in any orientation with a fixed rotational relationship on the axle 78, other positions of the elevator brackets 30 can also be defined as the zero position. The interaction of pinion 74 and chain 76 results in a step-up or step-down gearing of the movement of the tilt arm 34 with respect to the outer circumference of the connecting member 52 formed by the cam disks 70, 72, which are in each case arranged in pairs, thus enabling the zero position or a collision-free range to be set up very accurately.

Figure 8:
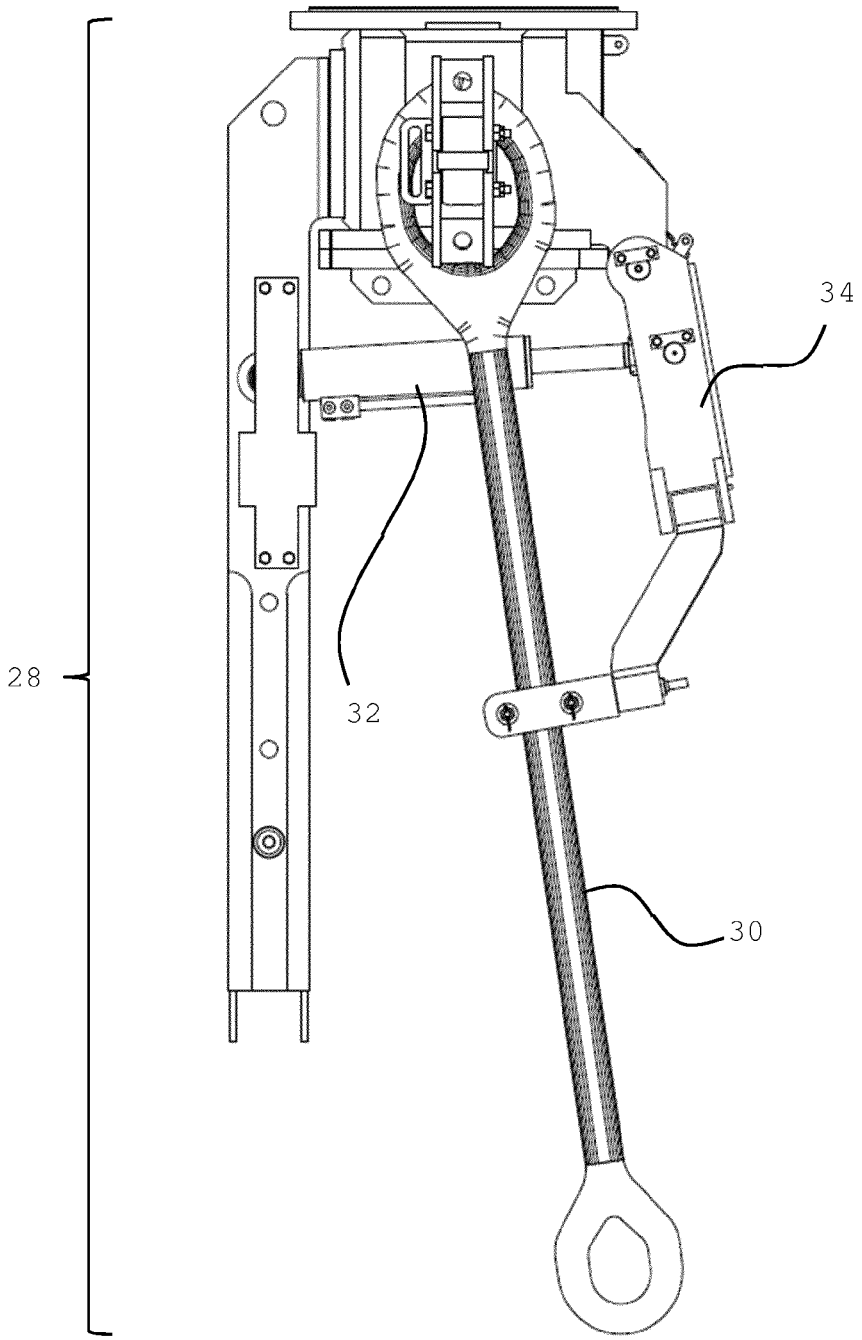
FIG. 8 shows the pipe handler in a side view with elevator brackets swiveled out of a zero position.

FIG. 8 shows an enlarged diagram of the pipe handler, that is to say the rotatable part 28 of the top drive 16 with elevator brackets 30 deflected slightly out of the vertical (only one visible). This position of the elevator brackets 30 is effected by an appropriate positioning of the tilt arm 34, which in turn is moved by the at least one actuating element 32, that is to say the or each tilt cylinder. By means of the chain 76 (FIG. 4) and the pinion 74, this movement of the tilt arm 34 effects a rotation of the camshaft (FIG. 7) and a rotation of the connecting members 52 formed by the cam disks 70, 72, which are in each case provided in pairs. FIG. 4 shows the situation corresponding to the position of the tilt arm 34 in FIG. 8. It can be seen that the two rollers 68 of the valves 50 are already located on the connecting members 52 in a region in which their outer contour coincides with the circular envelope contour, and the valves 50 accordingly open the hydraulic switching control circuit 54. This causes a pressure in the hydraulic switching control circuit 54 to reduce, which pressure can be sensed by means of the or each pressure sensor 56 and can be evaluated on the basis of a sensor signal generated by each pressure sensor 56 as position information regarding a position of the or each elevator bracket 30, here therefore as position information which indicates that the elevator brackets 30 are not in a position which is defined as the zero position.

Figure 9:
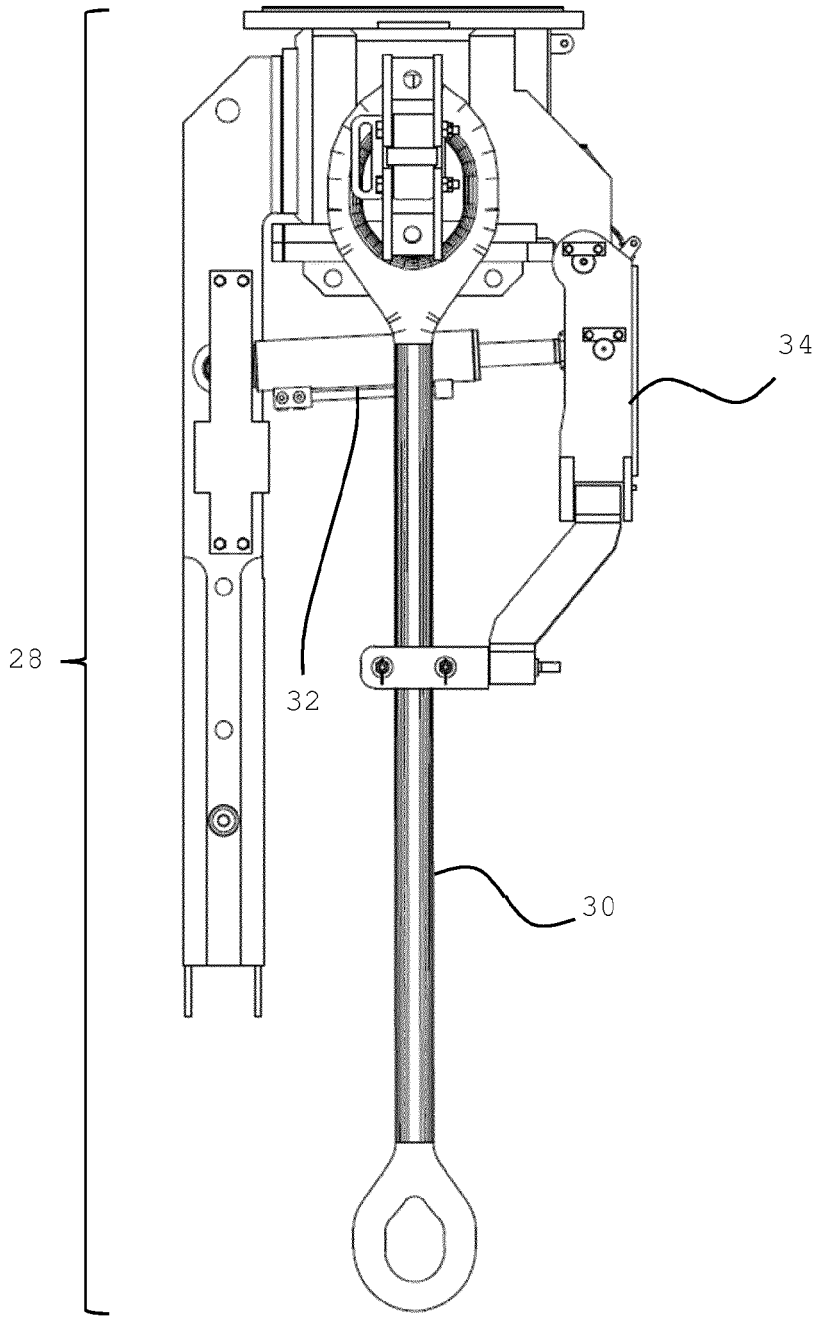
FIG. 9 shows the pipe handler in a side view with the elevator brackets in a zero position.
Figure 10:
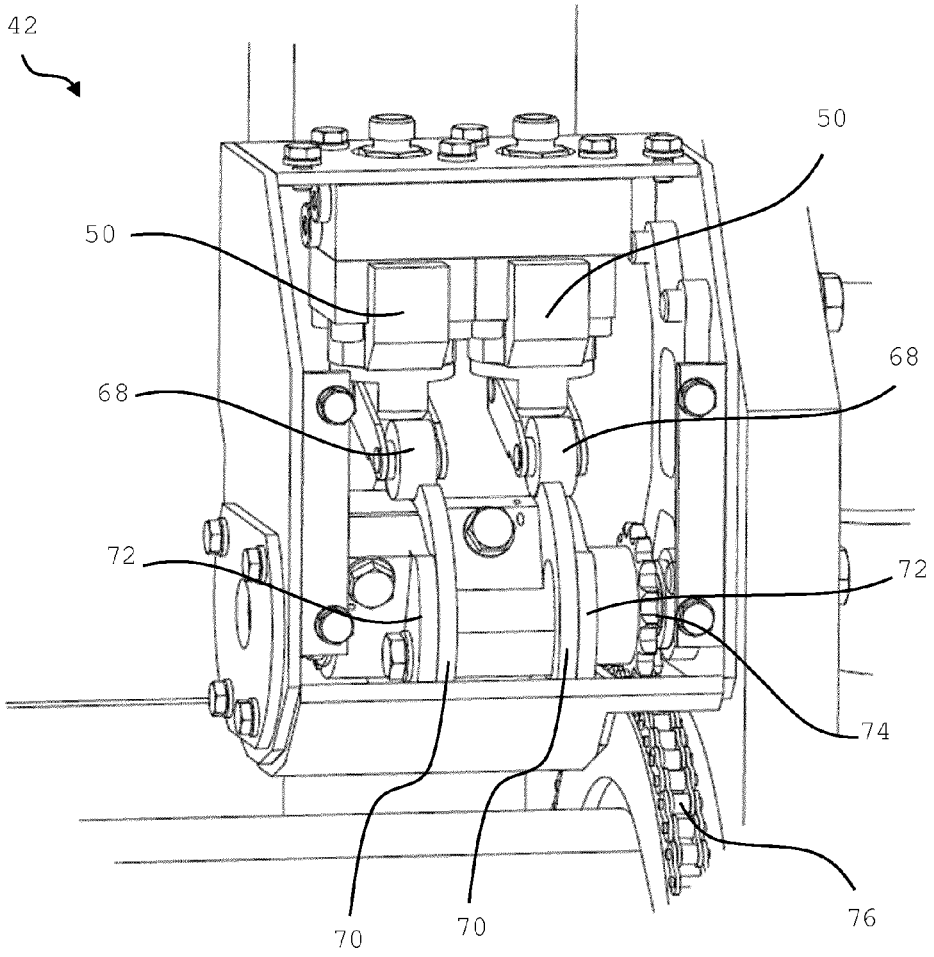
FIG. 10 shows the means for detecting the position of the or each elevator bracket according to FIG. 4 in a position of the elevator brackets in a zero position according to FIG. 9.

In comparison with this, FIG. 9 and FIG. 10 show the situation in which the elevator brackets 30 hang substantially vertically, wherein an associated position of the tilt arm 34 and a rotation of the connecting members 52, that is to say the cam disks 70, 72, effected by the chain 76 and the pinion 74, cause the rollers 68 of the valves 50 to just enter the inverse cam of the connecting member 52. In this position, the valves 50 are not actuated and therefore close the hydraulic switching control circuit 54 so that a resulting pressure in the hydraulic switching control circuit 54 can be sensed by the pressure sensors 56 and a resulting sensor signal can be evaluated as position information, here therefore as position information that the or each elevator bracket 30 is in its zero position.

It is basically unimportant whether the hydraulic switching control circuit 54 is open or closed in a position of the connecting member 52 or the connecting members 52 which corresponds to a zero position of the or each elevator bracket 30. However, in order that this does not lead to a critical misevaluation in the event of a possible pressure loss in the hydraulic switching control circuit 54 due to a fault situation, for example a failure of a hydraulic power pack which supplies the working pressure, in a particular embodiment, it is provided that the valves 50 close the hydraulic switching control circuit 54 in a position of the connecting members 52 which corresponds to a zero position of the or each elevator bracket 30.

The sensor signal generated by the pressure sensor 56 therefore indicates the zero position of the or each elevator bracket 30 only when there is sufficient operating pressure in the hydraulic switching control circuit 54 and when the connecting member 52/connecting members 52 is/are in an appropriate position. Every other position of the connecting member(s) 52 gives rise to a different sensor signal as does every loss of pressure in the hydraulic switching control circuit 54 resulting from a fault situation ("zero-pressure opening"). A zero position signal can accordingly only be output in the scenario defined above. The absence of the zero position signal means that the or each elevator bracket 30 is either not in the zero position, or otherwise that an exceptional situation prevails. The zero position signal or the absence of the zero position signal can be evaluated by a control device, for example in such a way that a vertical movement of the top drive 16 in the drilling mast 14 is only possible when the zero position signal is present. Conversely, a vertical movement of the top drive 16 can be immediately stopped if the zero position signal should disappear.

As, in a particular embodiment, two redundant valves are provided, it is ensured that, in the event of a failure of a single valve in the form of a leak, pressure is no longer built up in the hydraulic switching control circuit 54. The sensor signal generated by the pressure sensor 56, which already in itself constitutes a zero position signal or on the basis of which such a zero position signal or "free signal" can be derived, fails to materialize. The failure to materialize of such a signal can be used, for example, to hold the top drive 16 safely in the present vertical position until the fault has been rectified. If, on the other hand, the failure of a valve should express itself in that it remains closed (that is to say it can no longer be opened), then the second, redundant valve can ensure that the signal is detected. As a result of the parallel connection, one valve is sufficient to produce a pressure drop in the hydraulic switching control circuit 54.

A control device of the kind mentioned, that is to say a programmable logic controller or functionality realized in hardware for example, can also link the zero position signal of the or each pressure sensor 56 with a position signal which can be generated by the volume flow sensor 46 in such a way that a position signal generated or influenced by the volume flow sensor 46 is calibrated, that is to say reset to zero for example, with each zero position signal.

Individual important aspects of the description presented here can be briefly summarized as follows: Specified is a handling unit for drill rods having an elevator bracket 30 which can be swiveled by means of a tilt arm 34 under the influence of a tilt cylinder 32, and means 42 for detecting a position of the at least one elevator bracket 30, in which is provided at least one valve 50 as means for detecting the position of the or each elevator bracket 30 and as part of a hydraulic switching control circuit 54 which continues outside the handling unit, and at least one connecting member 52 for the at least one valve 50, which connecting member can be moved by a movement of the tilt arm 34, wherein the or each valve 50 opens the hydraulic switching control circuit 54 when the connecting member 52 is in a first position or location, and wherein the or each valve 50 closes the hydraulic switching control circuit 54 when the connecting member 52 is in a second position or location such that the state of the switching control circuit 54 can be evaluated as position information.

LIST OF REFERENCES

| | |
|---|---|
| 10 | Mast |
| 12 | Substructure |
| 14 | Fingerboard |
| 16 | Top drive |
| 18 | Drill rods |
| 20 | Pulley block |
| 22 | Crown block |
| 23 | Winch |
| 24 | Guide rail |
| 26 | Fixed part of top drive (base part) |
| 28 | Rotatable part of top drive |
| 30 | Elevator bracket |
| 32 | Actuating element (tilt cylinder) |
| 34 | Tilt arm |
| 36 | Torque arm |
| 38 | Holding tongs |
| 40 | Rotary hydraulic union |
| 42 | Means for detecting a position of the at least one elevator bracket |
| 44 | Hydraulic power circuit |
| 46 | Volume flow sensor |
| 48 | Valve manifold |
| 50 | Valve |
| 52 | Connecting member |
| 54 | Hydraulic switching control circuit |
| 56 | Pressure sensor |
| 58 | Manifold |
| 60 | Flow control valve |
| 62 | Reservoir |
| 64 | Non-return valve |
| 66 | Pressure control valve |
| 68 | Roller |
| 70 | (First) cam disk |
| 72 | (Second) cam disk |
| 74 | Pinion |
| 76 | Chain |
| 78 | Axle |
| 80 | Distance sleeve |

The invention claimed is:

1. A handling unit for drill rods having:

at least one elevator bracket (30) and means (42) for detecting a position of the at least one elevator bracket (30), wherein said elevator bracket is swivelable by means of a tilt arm (34) under the influence of at least one actuating element (32), said handling unit further comprising:

at least one valve (50) as means for detecting the position of the at least one elevator bracket (30) and as part of a hydraulic switching control circuit (54) which continues outside the handling unit, and at least one connecting member (52) for the at least one valve (50), said at least one connecting member being moveable by a movement of the tilt arm (34), wherein the at least one valve (50) opens the hydraulic switching control circuit (54) when the connecting member (52) is in a first position or location, and wherein the at least one valve (50) closes the hydraulic switching control circuit (54) when the connecting member (52) is in a second position or location.

2. The handling unit as claimed in claim 1, wherein the at least one connecting member comprises at least one cam disk (70, 72) mounted on an axle (78).

3. The handling unit as claimed in claim 2, wherein the at least one connecting member comprises the at least one cam disk and a second cam disk which are rotated relative to one another on the axle.

4. The handling unit as claimed in claim 2, wherein the cam disk (70, 72) is releasably locked in a fixed rotational relationship with respect to the axle (78).

5. The handling unit as claimed in claim 1, wherein the at least one connecting member (52) is driven by a pinion (74) which runs in a chain (76) driven by the tilt arm (34).

6. The handling unit as claimed in claim 1 comprising two valves (50) and two synchronously moving connecting members (52) for each valve (50).

7. The handling unit of claim 1, wherein the handling unit is part of a top drive (16) having a base part (26), wherein the handling unit is rotatable relative to the base part (26).

8. The handling unit and top drive of claim 7, wherein the hydraulic switching control circuit (54) runs via a rotary hydraulic union (40) from the handling unit to the base part (26), and wherein at least one pressure sensor (56) for detecting a pressure in the hydraulic switching control circuit (54) and for outputting a sensor signal relating thereto is located on the base part (26).

9. The handling unit and top drive as claimed in claim 8, wherein in a hydraulic power circuit (44) for controlling at least one hydraulic cylinder which functions as an actuating element (32), a volume flow sensor (46) for detecting a volume flow in the hydraulic power circuit (44) and for outputting a sensor signal relating thereto is located on the base part (26) as means for detecting a swivel position of the at least one elevator bracket (30).

10. The handling unit and top drive as claimed in claim 9, wherein the sensor signal obtainable from the pressure sensor (56) and the sensor signal obtainable from the volume flow sensor (46) are fed as input signals to a control device, wherein position information relating to a position of the at least one elevator bracket (30) is generated based on the sensor signal obtainable from the volume flow sensor (46), and wherein the position information can be calibrated based on the sensor signal obtainable from the pressure sensor (56).

* * * * *